US007140971B2

(12) United States Patent
Trudeau

(10) Patent No.: US 7,140,971 B2
(45) Date of Patent: Nov. 28, 2006

(54) PRACTICE PUTTING AND BALL RETRIEVING DEVICE

(76) Inventor: Larry C Trudeau, 2551 Mill Bay Road, Mill Bay, British Columbia (CA) V0R 2P1

( * ) Notice: Subject to any disclaimer, the term of this patent is extended or adjusted under 35 U.S.C. 154(b) by 0 days.

(21) Appl. No.: 10/874,163

(22) Filed: Jun. 24, 2004

(65) Prior Publication Data

US 2005/0288118 A1 Dec. 29, 2005

(51) Int. Cl.
*A63B 69/36* (2006.01)

(52) U.S. Cl. ..... 473/180; 473/181

(58) Field of Classification Search ..... 473/179–181, 473/185–189, 162; 294/19.2
See application file for complete search history.

(56) References Cited

U.S. PATENT DOCUMENTS 1,295,437 A * 2/1919 Cogswell ..... 273/127 D
3,074,722 A * 1/1963 Davenport ..... 473/189
3,451,682 A * 6/1969 Trimble ..... 473/189
3,652,095 A * 3/1972 Furnari et al. ..... 473/172
3,912,276 A * 10/1975 Keicher ..... 473/189
4,402,511 A 9/1983 Simjian
4,691,922 A 9/1987 Peel et al.
5,261,670 A 11/1993 Mull
5,368,352 A * 11/1994 Juhas ..... 294/19.2
5,409,231 A * 4/1995 Kueng et al. ..... 473/261
5,423,584 A 6/1995 Pasternak

* cited by examiner

*Primary Examiner*—Mark S. Graham
(74) *Attorney, Agent, or Firm*—Antony C. Edwards

(57) ABSTRACT

A practice putting device according to the present invention is an annular collar sized for a snug friction fit onto a conventional golf ball. The collar in use is placed on a putting surface so that the golf ball may be aimed at the collar opening when the collar is laid on its side. Upon a successful putt, a golf ball becomes frictionally lodged within the collar. The collar has a one inch depth which, when the putt has the correct weight, and is aimed exactly so as to lodge in the collar, the collar will flip up so that its opening is in a horizontal plane, and so as to hold the golf ball in the manner of an egg sitting in an egg cup.

8 Claims, 8 Drawing Sheets

PRACTICE PUTTING AND BALL RETRIEVING DEVICE

FIELD OF THE INVENTION

This invention relates to the field of golf and in particular to a device for both practicing putting and for picking up golf balls without having to bend over.

BACKGROUND OF THE INVENTION

In the sport of golf it is generally understood that in order to improve a player's game, the player must practice. This is because golf, both the so-called long game and short game, requires both a high degree of eye-to-hand coordination and a developed muscle-memory for successful play. In the short game on the putting green, a successful putt requires, again, eye-to-hand coordination and muscle memory to improve the two basic elements of a successful putt, namely, accuracy and weight. In order to sink a putt, the golf ball must arrive at the hole with sufficient accuracy that the ball will either fall directly into the cup or bounce off the inside of the rim around the hold and then fall into the cup. In the latter instance, if the ball has been driven too forcefully, that is, hit with too much so-called weight, then the golf ball will bounce off the rim and out of the cup rather than falling into the cup.

Hence there exists a need to practice both elements of a putt: vis, accuracy and weight in order to improve a player's eye-to-hand coordination and muscle memory so as to improve the golfer's short game.

In the prior art, applicant is aware of, of course, actual putting greens used exclusively for practice. These are typically found at golf courses. Applicant is also aware of practice putting devices simulating the hole found on a putting green, such devices typically lacking the form of target and lacking an indication of proper weight as provided in the present invention. What the present invention provides is a device for practicing putting virtually anywhere there exists a planar surface on which a player may stand and over which a golf ball may roll.

SUMMARY OF THE INVENTION

The practice putting device according to the present invention is an annular collar sized for a snug friction fit onto a conventional golf ball. The collar in use is placed on a putting surface so that the golf ball may be aimed at the collar opening when the collar is laid on its side. Upon a successful putt, a golf ball becomes frictionally lodged within the collar. The collar may have a nominal one inch depth and a nominal two inch opening for receiving the golf ball which, when the putt has the correct weight, and is aimed exactly so as to lodge in the collar, the collar will flip up so that its opening is in a horizontal plane, and so as to hold the golf ball in the manner of an egg sitting in an egg cup.

A length of plastic channel or track is provided to assist novice golfers in correctly aiming the golf ball so they can concentrate on the right weight of putt. Once the golfers have the correct weight of putt so that the golf ball flips up in the cup every time, then the plastic track may be removed and the novice golfer may concentrate on practicing both aim and weight.

The collar has a threaded hole in its side. A threaded spike threadably mounts into the hole for mounting of the collar on the spike into a putting green. This allows for practicing long putts. The spike is not completely threaded into the hole so that the collar is free to rotate about the long axis of the spike in the event that a putt is not correctly aimed. Once again, a correctly aimed putt will result in the golf ball frictionally lodging within the collar.

The spike also may be used to mount the collar into the hole typically found on the end of a golf club grip. This allows the club to be held inverted and used as a device for retrieving golf balls.

In summary, the practice putting device according to the present invention may be characterized by an annular cylindrical collar having a ball-receiving bore defined by the cylinder and a corresponding bore axis of symmetry (herein the bore axis). The collar has a height dimension parallel to the bore axis. The height dimension is less than the diameter of the collar measured perpendicular to the bore axis. The collar has a substantially cylindrical outside surface disposed radially outwardly of the bore axis so that the collar may be laid on its side on a planar or substantially planar surface with the bore axis substantially parallel to the planar surface. Advantageously the planar surface is generally horizontal, and the collar is oriented or is adapted so as to not roll but to remain stationary on the planar surface.

The diameter of the bore is sufficient for a snug friction fit of the collar onto the slightly resilient outer surface of a standard sized golf ball, preferably without the maximum girth of the golf ball fitting into the bore which would otherwise make retrieving the ball more difficult, and would alter the center of gravity of the combined ball and collar so that tipping-up of the collar would become possibly too easy and not teach the correct weight of putt.

DETAILED DESCRIPTION OF EMBODIMENTS OF THE INVENTION

Figure 1:
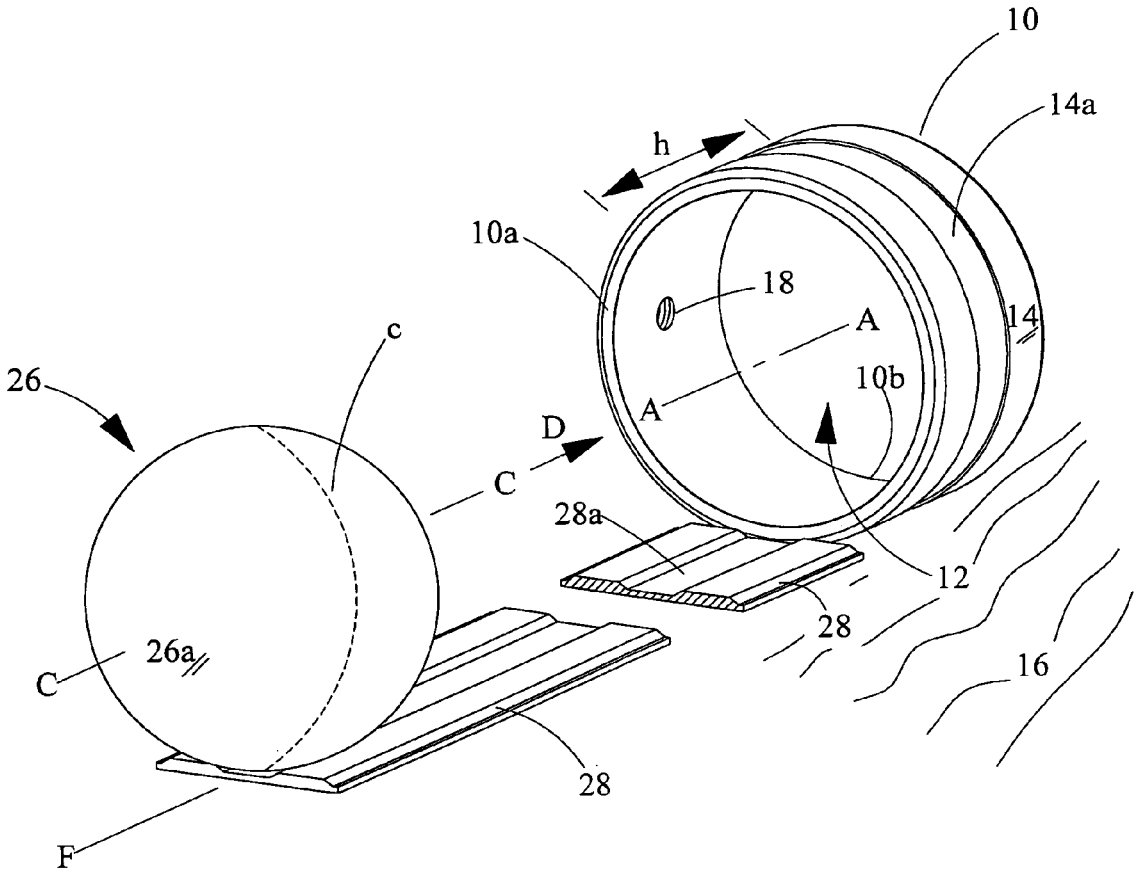
FIG. 1 is, in perspective view, one preferred embodiment according to the practice putting device of the present invention.
Figure 1A:
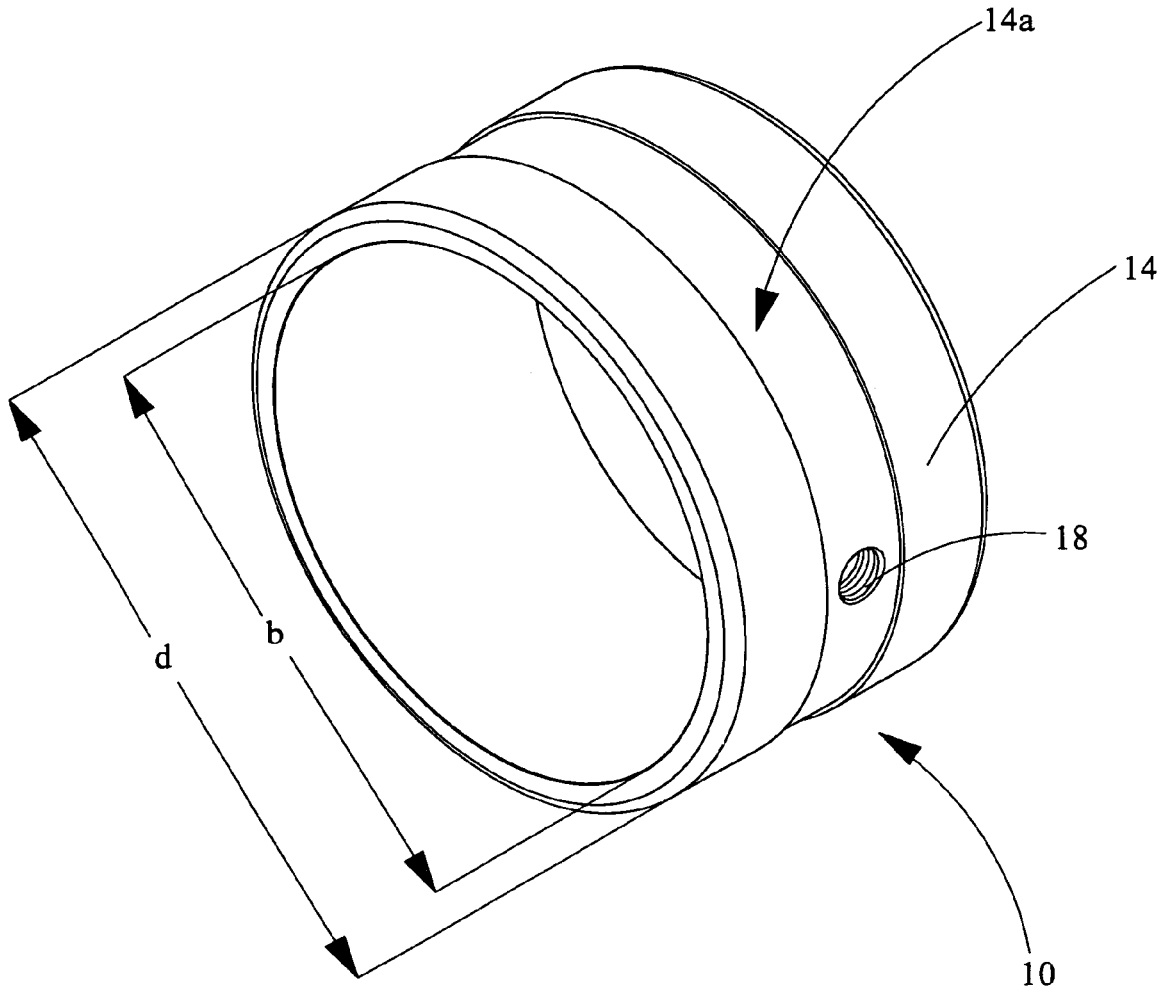
FIG. 1*a* is, in perspective view, the collar of FIG. 1.

With reference to the accompanying figures wherein similar characters of reference denote corresponding parts in each view, the practice putting device according to one embodiment of the present invention includes an annular cylindrical collar 10 having a ball-receiving bore 12 defined by the cylinder of the collar. Bore 12 has a corresponding bore axis of symmetry A, alternatively referred to herein as the bore axis A. Collar 10 has a height dimension h parallel to bore axis A. Height dimension h is less than the diameter d of collar 10 measured perpendicular to bore axis A. Collar 10 has a substantially cylindrical outside surface 14 disposed radially outwardly of bore axis A so that collar 10 may be laid on its side such as seen in FIG. 1 on a planar or substantially planar surface 16 with bore axis A substantially parallel to the planar surface. The planar surface 16 may be for example an indoor carpeted surface or other floor surface of a residence or office, or may be an outdoor surface wherever a user may find him or herself having five minutes or so of spare time in which to practice putting. And so, although referred to herein as being substantially planar, it is advantageous that for a novice that the planar surface 16 be initially horizontal and as the user gets more proficient perhaps may be undulating or inclined so as to simulate more difficult putting greens.

In the embodiment illustrated, which is not intended to limiting, outside surface 14 has an annular groove 14*a* disposed medially along the length of the cylinder. A threaded hole 18 is formed within groove 14*a* and extends through the side wall of collar 10 so as to open into bore 12. In a preferred embodiment, a spike 20 is provided having, at a first end, a point 22 and at its opposite end a threaded male member 24. Threaded male member 24 is sized for threaded engagement in threaded hole 18. Collar 10 may thus be anchored into planar surface 16 when, for example, planar surface 16 is a lawn or putting green by driving spike 20 in direction B into the ground.

Figure 4:
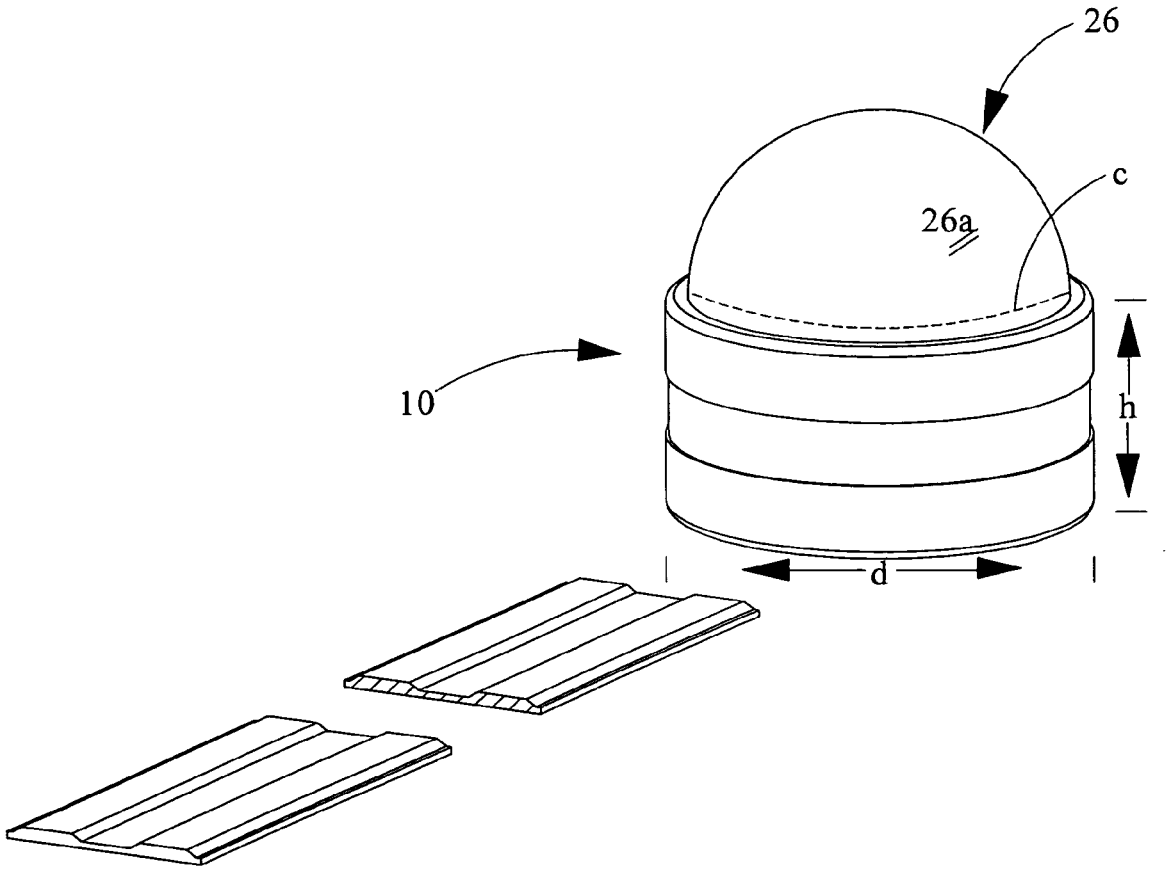
FIG. 4 is, in perspective view, the embodiment of FIG. 1 illustrating the result of a correctly aimed and correctly weighted putt resulting in the golf ball vertically nested into the collar.
Figure 5A:
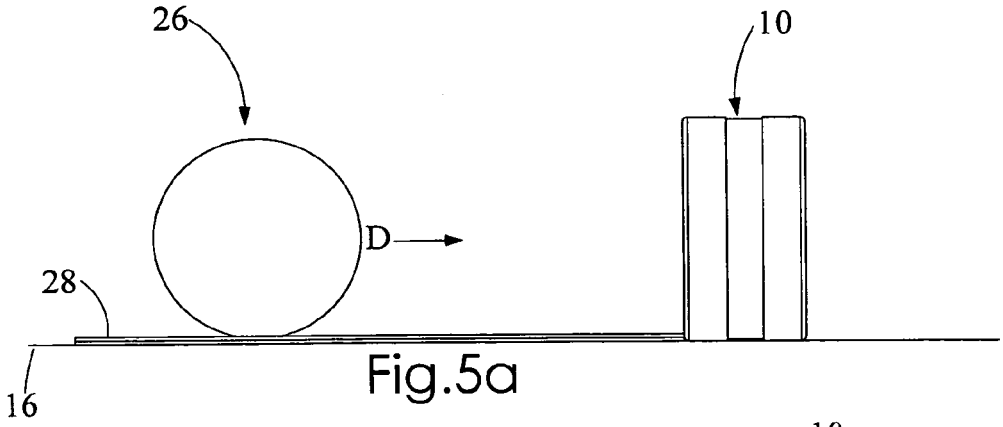
FIG. 5*a* is, in side elevation view, a golf ball approaching the collar according to the embodiment of FIG. 1.
Figure 5B:
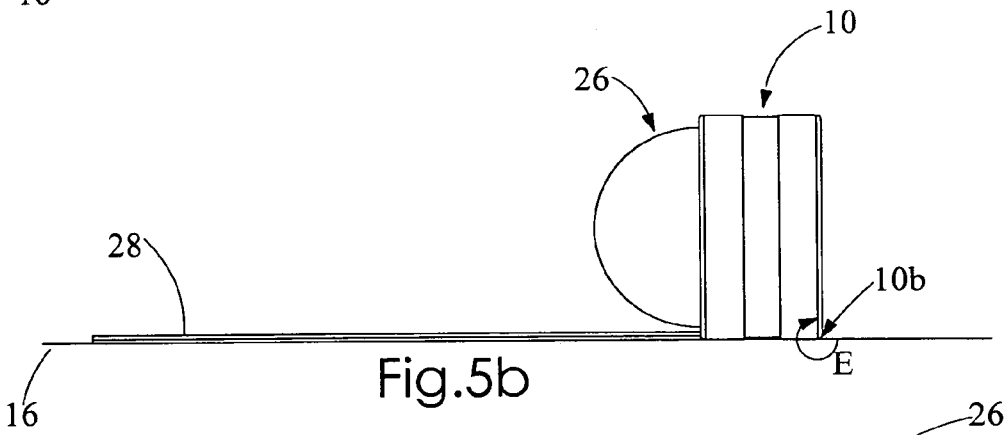
FIG. 5*b* is, in side elevation view, the golf ball of FIG. 5*a* initially engaging the collar so as to be frictionally wedged within the collar.
Figure 5C:
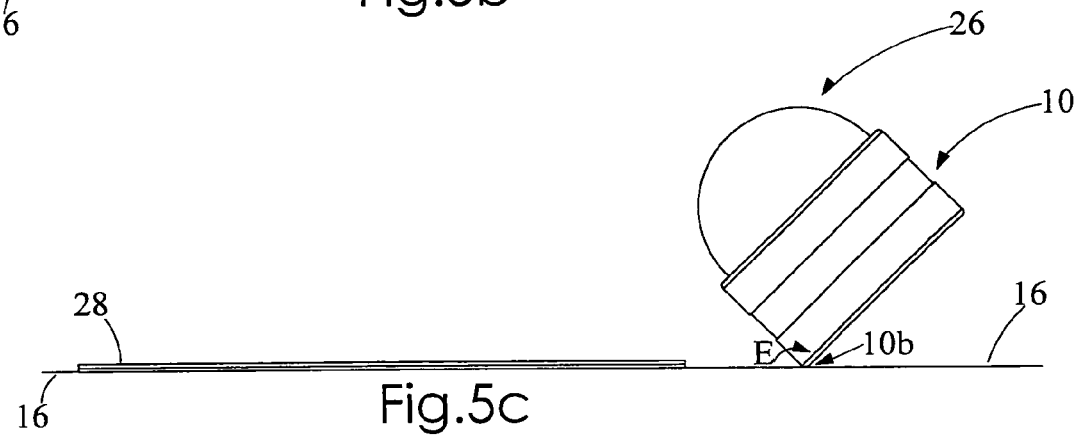
FIG. 5*c* is, in side elevation view, the continuing sequence of FIGS. 5*a* and 5*b* illustrating the effect of a correctly aimed and correctly weighted putt causing collar 10 to pivot from lying on its side to resting on its rim.
Figure 5D:
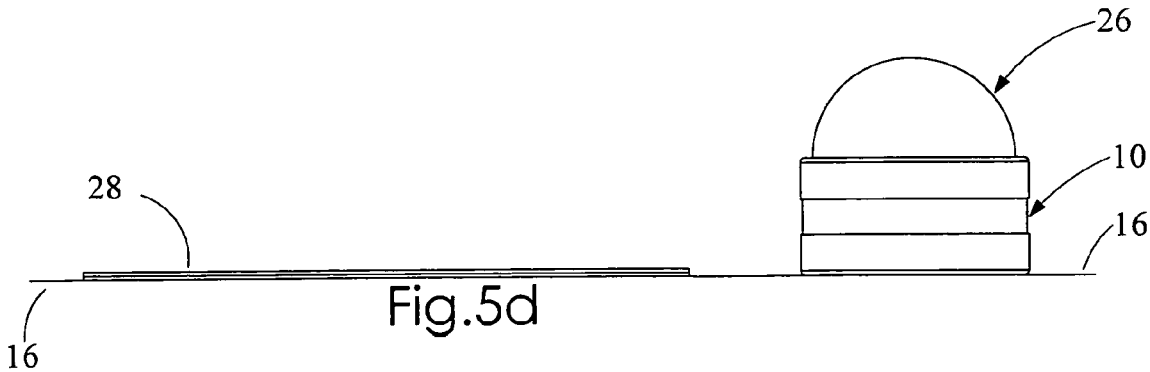
FIG. 5*d* illustrates the end of the sequence of FIGS. 5*a*–5*c* showing the golf ball vertically nested in the collar as a result of a correctly aimed and correctly weighted putt.

The bore diameter b, that is, the inside diameter of collar 10, is sized so as to provide a snug friction fit onto the slightly resilient outer surface 26*a* of golf ball 26. Preferably, diameter b is smaller, or at least slightly smaller than the diameter corresponding to the maximum circumference c of the golf ball. Thus as seen in FIG. 4, golf ball 26 may be snugly frictionally held in collar 10 in the manner of an egg snugly fitting within an egg cup, it being understood that the vertically supported golf ball of FIG. 4 is the end result of a successful putt using the present invention in one preferred manner as described better below. In one embodiment not intended to be limiting, outside diameter d is approximately 1⅞ inches, bore diameter b is approximately 1 11/16 inches, and height dimension h is approximately 15/16 of an inch. Thus the ratio of d:h is approximately 2:1. Collar 10 may be constructed of metal, in one particular embodiment aluminium, although other rigid materials will work, especially those of like density and weight. It is important to understand that it is not necessarily the material that is important to the functionality of the device. Rather, it is the specific weight of the device that makes it work. For example, if the device were heavier the ball would have to be struck harder, resulting in the ball travelling too far beyond the target in actual play. Likewise, if it were too light the ball would not travel far enough. In either case it might defeat the value and the purpose of this device as a putting training aid. The weight of this device is approximately 24.5 grams.

Thus in use, collar 10 is laid on its side as seen in FIG. 1 and a user putts golf ball 26 with the object being to, firstly, frictionally lodge golf ball 26 within bore 12, which would indicate that golf ball 26 was aimed accurately so as to align golf ball axis of symmetry C collinearly with bore axis A as golf ball 26 engages rim 10*a* of collar 10; and, secondly, that golf ball 26 is driven in direction D with sufficient weight so that once golf ball 26 engages rim 10*a* so as to become frictionally lodged within bore 12 by reason of axis C being collinear with bore axis A, the momentum of golf ball 26 is transferred in part to collar 10 causing collar 10 to tip upwardly and rearwardly so as to pivot about the lower extremity of rim 10*b* in direction E in accordance with the sequence illustrated in FIGS. 5*a*–5*d*.

For use by novices, a flexible linear track 28 may be provided so that novices may independently practice putting golf ball 26 with the correct weight without having to also concentrate on perfecting their aim simultaneously. Thus track 28, which may be for example three or four feet long, is bisected along its length by a medially disposed channel 28*a* so as to linearly guide golf ball 26 in direction D. In order to ensure that axis C coincides with bore axis A, the user merely aligns the longitudinal axis F of track 28 with bore axis A.

Figure 6:
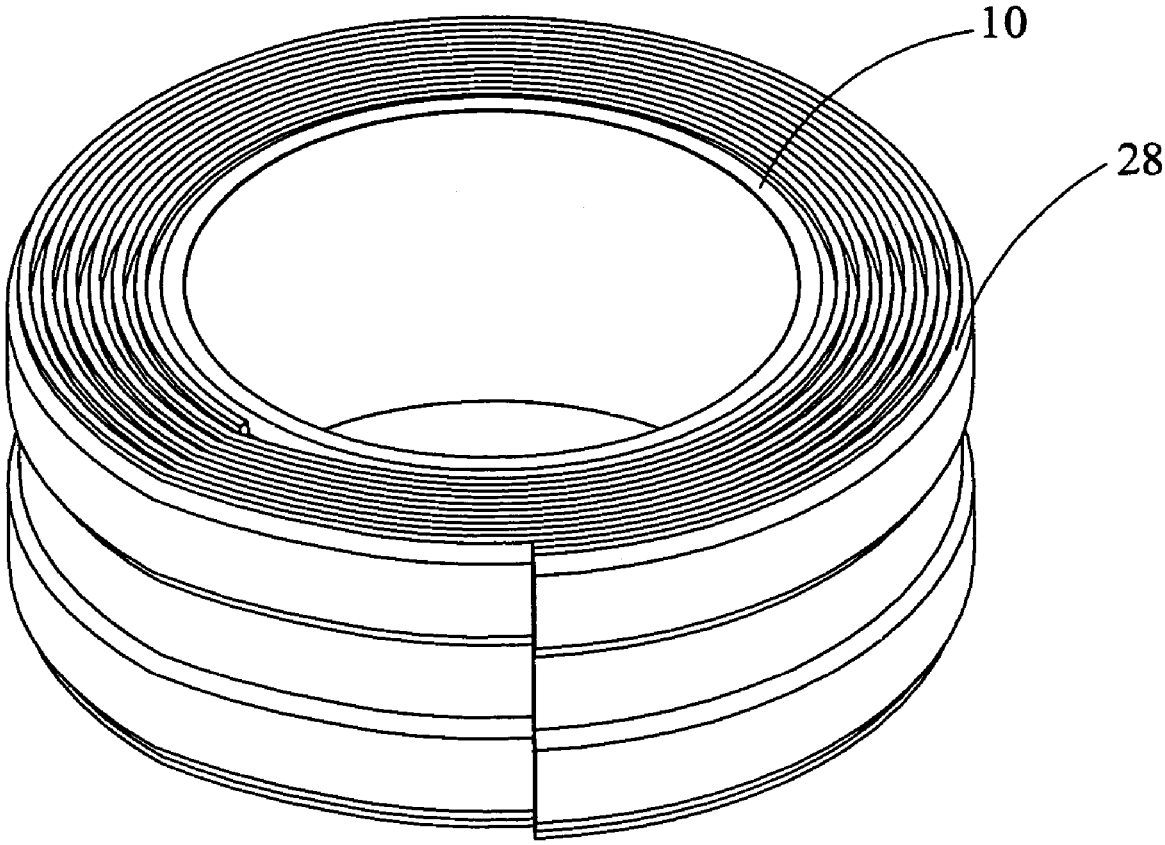
FIG. 6 is, in perspective view, the collar and flexible track of FIG. 1 coiled for storage.

When not in use, track 28 may be coiled as seen in FIG. 6. For example, track 28 may be coiled for storage around collar 10. This also provides a convenient and efficient shape for packaging the device for shipping and retail sale.

Figure 2:
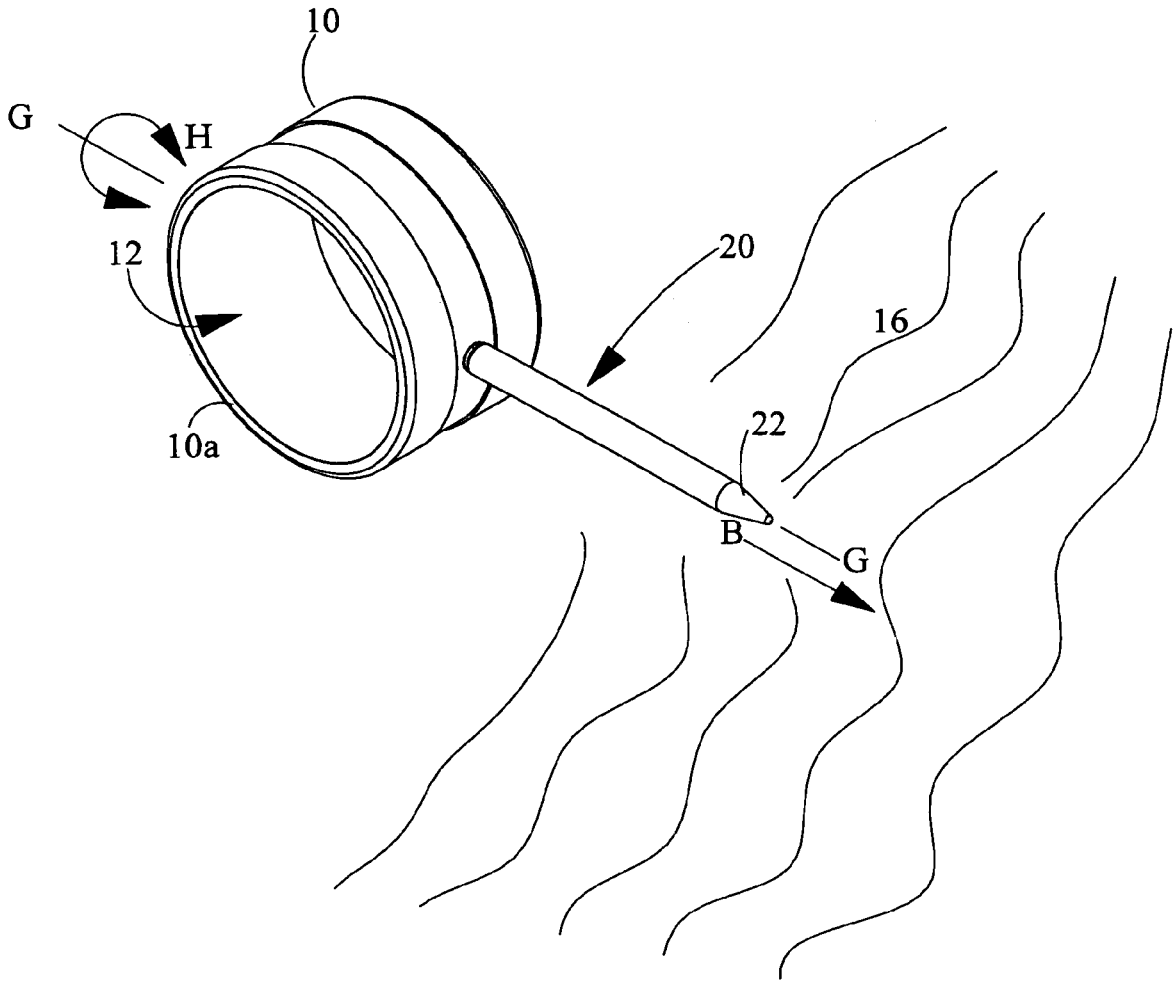
FIG. 2 is, in perspective view, the collar of FIG. 1*a* mounted on a spike.
Figure 3:
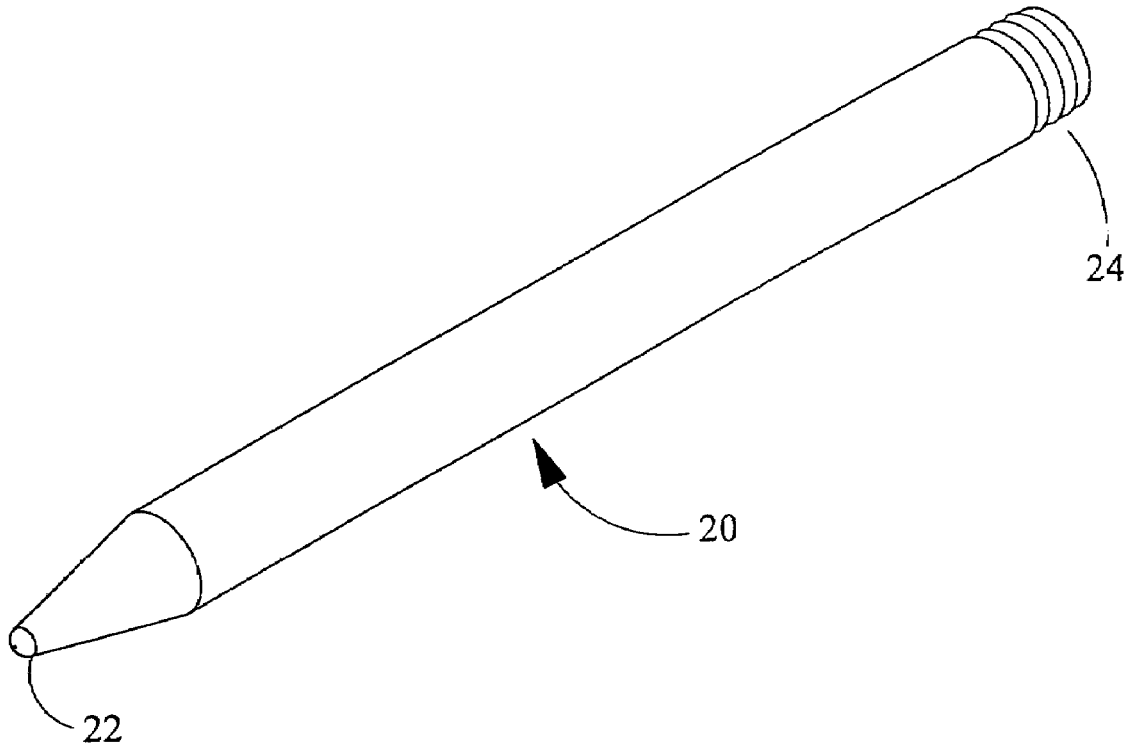
FIG. 3 is, in perspective view, the spike of FIG. 2.

With respect to the embodiment of FIG. 2, in use, a user would thread spike 20 into threaded hole 18 without threading spike 20 all of the way into the hole. This then allows collar 10 to freely pivot about the longitudinal axis G in direction H relative to spike 20 when spike 20 is mounted into the ground. Thus, if golf ball 26 is not accurately aimed, so that upon golf ball 26 engaging rim 10*a*, if axis C is not collinear with bore axis A, golf ball 26 will cause collar 10 to rotate in direction H and will glance off collar 10 rather than becoming lodged with bore 12.

Figure 7:
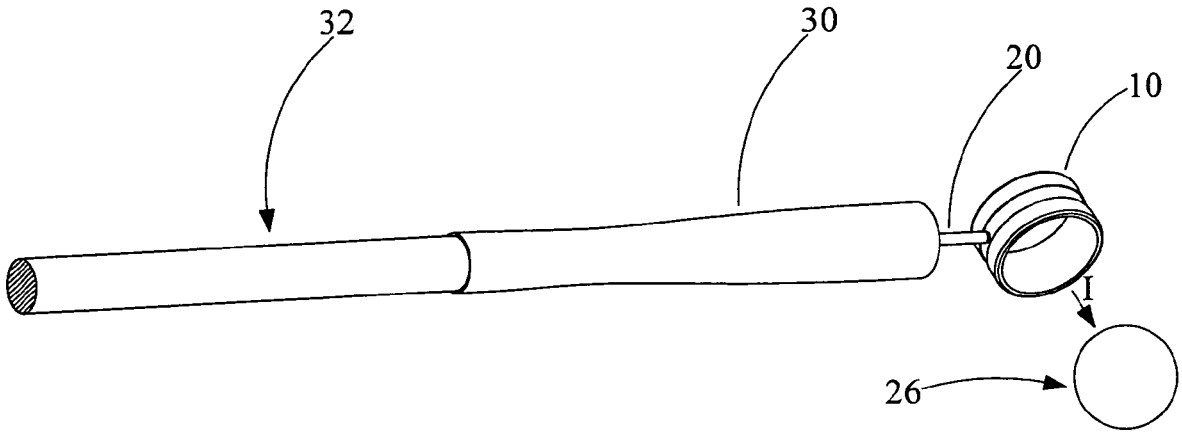
FIG. 7 is, in perspective view, the embodiment of FIG. 2 mounted into the grip of a golf club for use as a device for picking up a golf ball.

As seen in FIG. 7, spike 20 may be mounted into a golf club grip 30 by inserting spike 20 into the aperture typically found in the distal end of a typical grip 30. Spike 20 is sized so as to frictionally fit into a conventional such aperture. With spike 20 so mounted into the distal end of grip 30, the inverted golf club 32 may be used for picking up golf balls 26 by driving collar 10 downwardly in direction I so as to wedge golf ball 26 within bore 12 and allowing the user to use this device as a ball retriever. For this use, it is advantageous that spike 20 be fully threaded into hole 18 so that collar 10 is not easily rotated in direction H relative to spike 20.

As will be apparent to those skilled in the art in the light of the foregoing disclosure, many alterations and modifications are possible in the practice of this invention without departing from the spirit or scope thereof Accordingly, the scope of the invention is to be construed in accordance with the substance defined by the following claims.

What is claimed is:

1. A practice putting system comprising:

(a) an elongate track formed as an elongate channel for supporting a golf ball in rolling engagement therealong; and (b) an annular rigid cylindrical collar having a ball-receiving bore and a corresponding bore axis of symmetry, wherein said collar has a height dimension parallel to said bore axis which is less than the diameter of the collar measured perpendicular to said bore axis, and wherein said collar has a substantially cylindrical outside surface disposed radially outwardly of said bore axis whereby said collar may be laid on its side on a planar surface with said bore axis substantially parallel to the planar surface, and wherein said bore is sized to snugly receive the golf ball in frictional engagement in said bore, said collar may be laid on its side and said track may be aligned with said bore so that a golf ball rolling along said track will become frictionally lodged in said bore, whereby, if hit with correct weight, the golf ball will flip said collar over by ninety degrees so as to lay flat with said bore axis then perpendicular to the planar surface.

2. The device of claim 1 wherein said bore has a diameter sufficient for a snug friction fit of said collar onto the outer surface of the golf ball without the maximum girth of the golf ball fining into said bore.

3. The device of claim 2 to wherein an outside diameter of said collar forms a ratio of substantially 2:1 with said height dimension.

4. The device of claim 3 wherein said collar is of metal.

5. The device of claim 3 wherein said outside diameter is substantially two inches and said height dimension is substantially one inch.

6. The device of claim 1 wherein an aperture is formed in a side wall of said collar and further comprising an elongate spike mountable into said aperture so as to extend outwardly of said collar for mounting said collar into the ground.

7. The device of claim 6 wherein said spike is rotatably mountable onto said aperture.

8. The device of claim 7 wherein said aperture is threaded and one end of said spike correspondingly threaded far threaded mating in said aperture.

* * * * *